US006280149B1

(12) United States Patent
Able et al.

(10) Patent No.: US 6,280,149 B1
(45) Date of Patent: Aug. 28, 2001

(54) ACTIVE FEEDBACK APPARATUS AND AIR DRIVEN DIAPHRAGM PUMPS INCORPORATING SAME

(75) Inventors: Stephen D. Able, Bryan, OH (US); Joseph L. Meloche, Royal Oak, MI (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/428,945

(22) Filed: Oct. 28, 1999

(51) Int. Cl.[7] ..... F04B 49/00
(52) U.S. Cl. ..... 417/63; 417/395
(58) Field of Search ..... 417/63, 293, 397, 417/413, 415, 417, 395; 350/96.2; 335/258; 60/432

(56) References Cited

U.S. PATENT DOCUMENTS

| | | | | |
|---|---|---|---|---|
| 2,224,463 | | 12/1940 | Wineman | 417/375 |
| 2,404,315 | | 7/1946 | Rotter et al. | 417/375 |
| 2,898,005 | | 8/1959 | Rotter | 417/375 |
| 3,513,408 | | 5/1970 | McGee | 331/65 |
| 3,838,946 | | 10/1974 | Schall | 417/395 |
| 3,848,411 | * | 11/1974 | Strawn | 60/432 |
| 4,181,066 | | 1/1980 | Kitchen et al. | 91/306 |
| 4,381,180 | | 4/1983 | Sell | 417/393 |
| 4,444,547 | | 4/1984 | Stolz | 417/46 |
| 4,512,627 | * | 4/1985 | Archer et al. | 350/96.2 |
| 4,599,052 | | 7/1986 | Langen et al. | 417/413.1 |
| 4,623,840 | | 11/1986 | Fujimura et al. | 324/208 |
| 4,667,158 | | 5/1987 | Redlich | 324/207 |
| 4,674,958 | | 6/1987 | Igarashi et al. | 417/225 |
| 4,717,874 | | 1/1988 | Ichikawa et al. | 324/208 |
| 4,775,301 | * | 10/1988 | Cartwright et al. | 417/417 |
| 4,778,356 | * | 10/1988 | Hicks | 417/397 |
| 4,832,582 | * | 5/1989 | Buffet | 417/413 |
| 4,854,832 | | 8/1989 | Gardner et al. | 417/393 |
| 4,856,969 | | 8/1989 | Forsythe et al. | 417/395 |

(List continued on next page.)

FOREIGN PATENT DOCUMENTS

| | | |
|---|---|---|
| 3347052A1 | 7/1985 | (DE) . |
| 1558206 | 12/1979 | (GB) . |
| 1413408A1 | 7/1988 | (SU) . |

OTHER PUBLICATIONS

Roberts, Howard C., "Electric Gaging Methods for Strain, Movement, Pressure, and Vibration," Instruments, vol. 17, pp. 334–339 (Jun. 1944).

OMEGA Complete Pressure, Strain, and Force Measurement Handbook and Encyclopedia, pp. J–7 to J–12 and J–25 to J–28.

*Primary Examiner*—Charles G. Freay
(74) *Attorney, Agent, or Firm*—Leon Nigohosian, Jr.

(57) ABSTRACT

A diaphragm pump having an active feedback system is provided. The diaphragm pump includes a diaphragm pump having a housing including a pumping cavity. The pump cavity having at least one diaphragm dividing the pumping cavity into a first pumping chamber and a first pump actuating chamber. A rod is attached to and reciprocally movable along an axis with the at least one diaphragm with the rod including a ferromagnetic material. An induction coil disposed around the rod wherein relative axial movement between the inductance coil and the ferromagnetic material of the rod varies the inductance of the induction coil. Also provided is a diaphragm pump having an active feedback system in which the rod has an electrically conductive, diametrically tapered portion. A linear displacement sensor is disposed next to the tapered portion which induces a current in the tapered portion and generates an output voltage proportional to a relative position between the linear displacement sensor and the tapered portion.

6 Claims, 3 Drawing Sheets

U.S. PATENT DOCUMENTS

| | | | | |
|---|---|---|---|---|
| 4,895,497 | | 1/1990 | Schlinkheider | 417/403 |
| 4,936,753 | | 6/1990 | Kozumplik, Jr. et al. | 417/238 |
| 4,966,528 | | 10/1990 | Henkel et al. | 417/63 |
| 5,013,223 | * | 5/1991 | Takahashi et al. | 417/413 |
| 5,045,785 | | 9/1991 | Hansen | 324/207.16 |
| 5,046,702 | | 9/1991 | MIyazawa et al. | 251/129.04 |
| 5,055,007 | | 10/1991 | Geddings | 417/393 |
| 5,104,298 | * | 4/1992 | Takahashi et al. | 417/415 |
| 5,111,139 | | 5/1992 | Rose | 324/207.22 |
| 5,138,291 | * | 8/1992 | Day | 335/258 |
| 5,201,641 | * | 4/1993 | Richer | 417/417 |
| 5,232,352 | | 8/1993 | Robinson | 417/393 |
| 5,252,041 | | 10/1993 | Schumack | 417/395 |
| 5,257,914 | * | 11/1993 | Reynolds | 417/293 |
| 5,277,555 | | 1/1994 | Robinson | 417/393 |
| 5,279,504 | | 1/1994 | Williams | 417/393 |
| 5,368,452 | | 11/1994 | Johnson et al. | 417/395 |
| 5,378,122 | | 1/1995 | Duncan | 417/395 |
| 5,391,060 | | 2/1995 | Kozumplik, Jr. et al. | 417/393 |
| 5,438,261 | | 8/1995 | Codina et al. | 324/207.16 |
| 5,499,909 | | 3/1996 | Yamada et al. | 417/384 |
| 5,520,523 | | 5/1996 | Yorita et al. | 417/387 |
| 5,527,160 | | 6/1996 | Kozumplik, Jr. et al. | 417/46 |
| 5,567,118 | | 10/1996 | Grgurich et al. | 417/46 |
| 5,616,005 | | 4/1997 | Whitehead | 417/46 |
| 5,735,250 | | 4/1998 | Rembold et al. | 123/504 |
| 5,816,778 | | 10/1998 | Elsey, Jr. et al. | 417/46 |
| 5,886,617 | | 3/1999 | Meloche et al. | 338/176 |

* cited by examiner

ACTIVE FEEDBACK APPARATUS AND AIR DRIVEN DIAPHRAGM PUMPS INCORPORATING SAME

This invention relates to active feedback devices for diaphragm pumps, and more particularly for air operated diaphragm pumps.

Air operated diaphragm pumps use compressed air to operate diaphragms which alternately draw in and discharge a material to be pumped. Such diaphragm pumps are known in the art and are widely used in pumping a wide variety of materials. Examples are shown in U.S. Pat. Nos. 4,854,832; 4,936,753; and 5,391,060, the disclosures of which are incorporated herein by reference. The diaphragm pumps disclosed in these patents have a first diaphragm coupled to a first end of an axially reciprocating shaft, and a second diaphragm coupled to a second end of the shaft. Each diaphragm constitutes a flexible wall that separates a liquid chamber from an air chamber. The liquid chambers are connected to a common intake manifold and a common discharge manifold, and check valves are positioned at the fluid inlets and outlets of the fluid chambers.

In operation, the axially reciprocating shaft is reciprocated by pressurizing the first air chamber while venting the second air chamber, and then venting the first air chamber while pressurizing the second air chamber. As the shaft moves in one direction, the first diaphragm pushes the fluid out of its fluid chamber into the discharge manifold, while the second diaphragm draws fluid into its fluid chamber from the intake manifold. When the diaphragms and connecting rod have traveled a predetermined distance, a mechanical switch is tripped. This mechanical switch in turn shifts a main valve that reverses the pneumatic action to pressurize the second air chamber and reverse the direction of the shaft. As the shaft begins to move in the other direction, the first diaphragm draws fluid into its chamber from the intake manifold, and the second diaphragm pushes the fluid out of its chamber into the discharge manifold. The pump continues this reciprocation until the air supply is stopped.

Various factors including the dynamics of the fluid being pumped affect the rate of reciprocation of the connecting rod. In the case of more viscous fluids, for a given air supply pressure, the connecting rod will be caused to reciprocate more slowly thus reducing the output rate of the pump. In attempting to compensate for inequalities between the desired output and the actual output of the pump, passive control systems have been used to measure the pump output and perform some function to increase or decrease the rate of reciprocation of the connecting shaft. One problem with conventional diaphragm pumps having such passive control systems is that they are not readily controllable except by the introduction of external flow measuring devices which add to the complexity and expense of the pump.

The foregoing illustrates limitations known to exist in present diaphragm pumps. Thus it is apparent that it would be advantageous to provide an alternative directed to overcoming one or more of the limitations set forth above. Accordingly an alternative diaphragm pump having active feedback monitoring is provided including the features more fully disclosed hereinafter.

SUMMARY OF THE INVENTION

According to the present invention, diaphragm pumps having active feedback systems are provided. In a first embodiment, the diaphragm pump includes a diaphragm pump having a housing including a pumping cavity. The pump cavity having at least one diaphragm dividing the pumping cavity into a first pumping chamber and a first pump actuating chamber. A rod is attached to and reciprocally movable along an axis with the at least one diaphragm with the rod including a ferromagnetic material. An induction coil disposed around the rod wherein relative axial movement between the inductance coil and the ferromagnetic material of the rod varies the inductance of the induction coil.

In a second embodiment, a diaphragm pump is provided having an active feedback system in which the rod has an electrically conductive, diametrically tapered portion. A linear displacement sensor is disposed next to the tapered portion which induces a current in the tapered portion and generates an output voltage proportional to a relative position between the linear displacement sensor and the tapered portion.

The foregoing and other aspects will become apparent from the following detailed description of the invention when considered in conjunction with accompanying drawing figures.

BRIEF DESCRIPTION OF THE DRAWING FIGURES

DETAILED DESCRIPTION OF THE PREFERRED EMBODIMENTS

Figure 1:
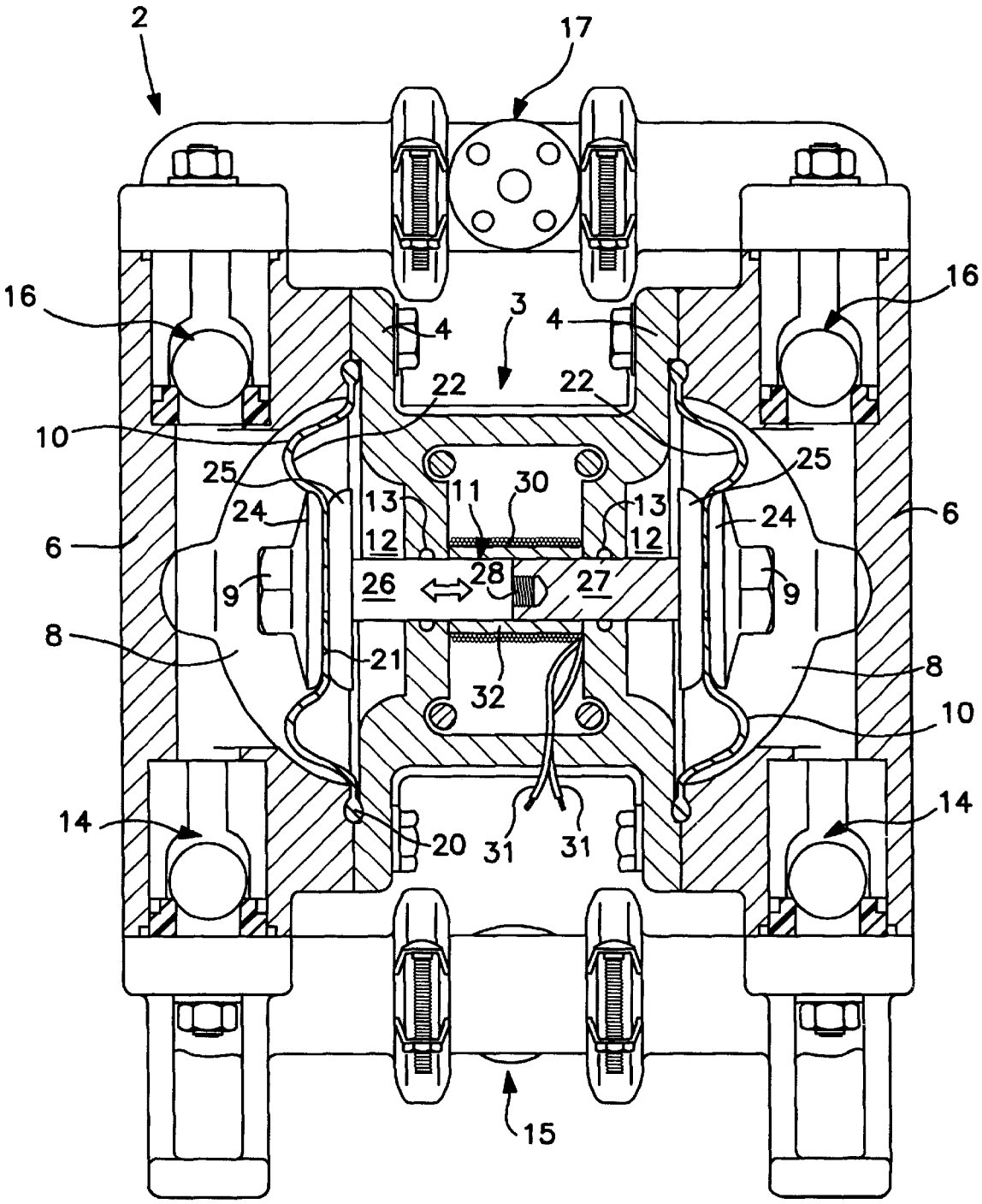
FIG. 1 is a partial cross-sectional view of a diaphragm pump having an active feedback system according to one embodiment of the present invention.

The invention is best understood by reference to the accompanying drawings in which like reference numbers refer to like parts. It is emphasized that, according to common practice, the various dimensions of the component parts shown in the drawings are not to scale and have been enlarged for clarity.

Referring now to the drawings, shown in FIG. 1 is a diaphragm pump 2 having two pumping cavities formed between an air cap 4 and a fluid cap 6 and an active feedback system according to the present invention. Each cavity includes a pumping chamber 8 and a pump actuating chamber 12 that are separated by a pumping diaphragm 10 spanning the width of the cavity. Typically, pumping chambers 8 receives a fluid for pumping, however, particulate matter such as powders may also be pumped. Typically, pump actuating chambers 12 are provided with air as the motive gas, however, other gases such as nitrogen may be utilized for this purpose.

Diaphragms 10 are generally circular membranes typically made of a relatively flexible material, e.g., rubber or a thermoplastic elastomer (TPE), and having an outer peripheral portion 20 that is clamped or otherwise held in a stationary position against the pump housing. Diaphragms 10 also include a centrally located portion 21 and a working portion 22 that joins the central and peripheral portions. The central portion 21 is typically clamped between a pair of rigid backup washers 24, 25 and secured by a threaded bolt 9 which passes through centrally located holes in the backup washers and the diaphragm into the ends of connecting rod 11 as shown.

Rigid backup washers 24, 25 are typically metal castings that provide rigid support for diaphragms 10 during operation of diaphragm pump 2. The working and central portions of the diaphragm are displaced in a reciprocating manner as described above to drive liquid out of the pump. O-rings 13 disposed on connecting rod 11 seal each pump actuating chamber 12 from the other. Each pumping chamber 8 is connected to an intake valve 14 and exhaust valve 16, with (i) intake valve 14 connected through an intake manifold 15 to a source of fluid or other material to be pumped through the pump and (ii) the exhaust valve 16 connected to an exhaust manifold 17. By introducing a motive fluid such as pressurized air into one pump actuating chamber 12, the pressure acts on the diaphragm spanning the air cap causing the diaphragm to move toward its fluid cap 6. This displaces the fluid being pumped from the pumping chamber 8 and forces it to travel out the exhaust valve 16 and exhaust manifold 17. As the diaphragm moves, it pulls connecting rod 11 which, in turn, pulls the other diaphragm away from its corresponding fluid cap and toward its corresponding air cap, thereby drawing fluid into the other pumping chamber through its intake valve 14 and intake manifold 15. At the end of the stroke, the pressurized air cap is exhausted and the exhausted air cap is pressurized, reversing the motion. Thus, the diaphragm pump accomplishes a nearly constant flow of pumping through the pump by continuously driving the connecting rod back and forth in the pump.

According to the present invention, active feedback apparatus are provided which anticipate an output condition of a pump by reading and interpreting internal device conditions and performing some function to compensate for inequalities before they occur at the output. This is accomplished by directly and continuously monitoring the position of the diaphragms at any time during-the pump's operation. In double diaphragm pumps, because the connecting rod forms a solid link between the diaphragms, a change in its position directly represents that of the diaphragms. Thus, the output of the diaphragm pump is directly proportional to the movement of the connecting rod.

Generally, the active feedback apparatus according to the present invention operate by measuring the movement of the connecting rod. The movement of the connecting rod is measured in terms of its position (i.e., displacement). The rate of reciprocation (i.e., velocity) or change in the rate of reciprocation (i.e., acceleration) of the connecting rod can also be derived by measuring the displacement of the connecting rod with respect to time.

Shown in FIG. 1 is a first embodiment of the present invention in which a diaphragm pump 2 having a housing 3 is provided with an active feedback apparatus having an inductance coil 30 which includes an insulated wire wound about a reciprocally movable connecting rod 11. Inductance coil 30 is disposed around and does not contact connecting rod 11, and thus does not affect, the motion of the rod. By this design, the non-contact operation of the inductance coil provides an added inherent benefit of virtually infinite life.

Inductance coil 30 may be manufactured from any electrically conductive wire which is externally insulated. Preferably, the conductive wire is a copper wire or "music wire." Music wire is a high carbon, low alloy steel with a smooth finish and typically having a gauge of 25 to 32. As will become apparent to those skilled in the art, the dimensions of the inductance coil are dependent upon the diameter and stroke of the connecting rod.

Inductance coil 30 is connected via leads 31 to a standard LC-type oscillator (not shown) that produces a sinusoidal waveform (i.e., one having an amplitude change as a sine function such as alternating current). In response to the inductance of the inductance coil 30, the alternating current produces a position signal that is representative of the linear position of the connecting rod relative to the inductance coil as described in greater detail below. A suitable oscillator may include a Colpitts oscillator, which is well known in the art.

Connecting rod 11 includes a ferromagnetic material such that relative axial movement between inductance coil 30 and the ferromagnetic material of rod 11 varies the inductance of the coil. Connecting rod 11 reciprocates within a connecting tube 32 that is located between and connects pump actuating chambers 12. Preferably, connecting tube 32 is made of an electrically insulating material to electrically isolate the inductance coil from connecting rod. Alternately, connecting rod 11 may be coated with an epoxy to electrically isolate the inductance coil 30 from the rod 11. For example, a suitable coating may include an epoxy resin manufactured by Dow Chemicals of Midland, Mich., as product no. DER331 mixed with a polysebasic polyanhydride (PSPA) manufactured by Cambridge Industries of America of Newark, N.J. However, any other suitable non-conductive coating may be used.

Preferably, connecting rod 11 is formed of two connected halves of different materials, a ferromagnetic half 26 and a non-ferromagnetic half 27. Ferromagnetic half 26 is made from a material which can be attracted magnetically and, preferably, is made of iron or nickel. Non-ferromagnetic half 27 is made of a material which cannot be attracted magnetically and, preferably, is made of stainless steel or plastic. Ferromagnetic half 26 and non-ferromagnetic half 27 are connected, preferably, by a threaded screw 28. By this construction, upon moving connecting rod within connecting tube 32 as shown in FIGS. 2A–2C and described in greater detail below, the movement of the non-ferrous metal alone within inductance coil does not affect the resultant impedance of the coil.

Figure 2A:
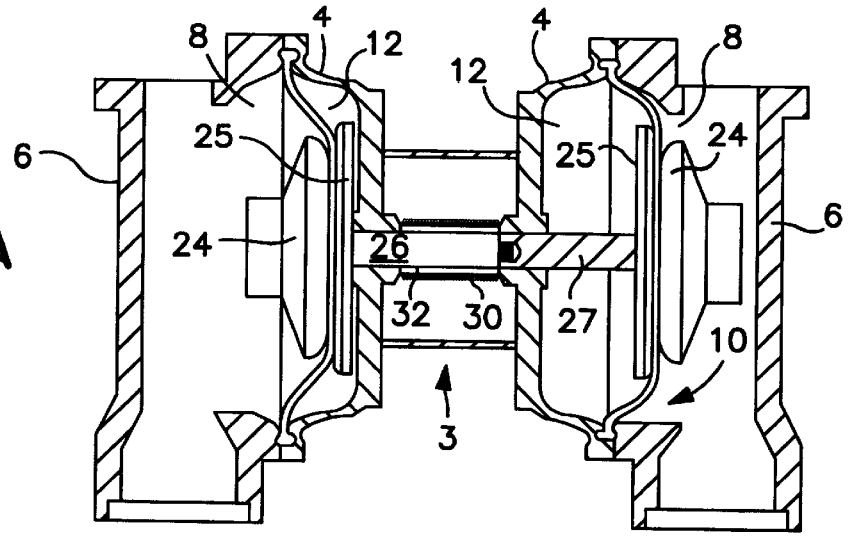
FIGS. 2A–2C are cross-sectional schematic views of the diaphragm pump shown in FIG. 1 moving through successive stages of a pumping stroke.
Figure 2B:
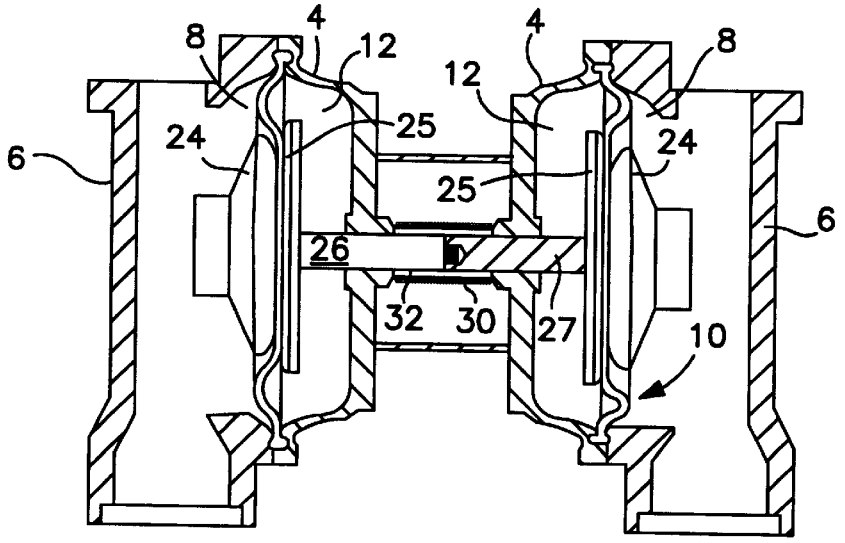
Figure 2C:
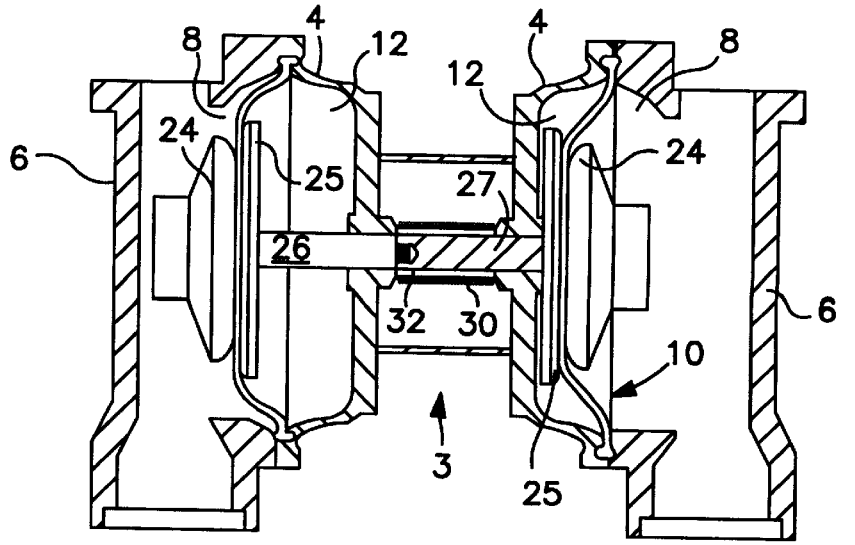

Referring now to the drawings, shown in FIGS. 2A–2C is a cross-sectional schematic that illustrates the motion of two diaphragms 10 as they move through successive stage of a pumping stroke within the pumping chambers 8 and pump actuating chambers 12 of diaphragm pump shown in FIG. 1. Operation of the pump is as described above with respect to the diaphragm pump 2 shown in FIG. 1 and is accomplished by first introducing pressurized air to the left diaphragm 10 shown in FIG. 2A causing it to exert force on the pumping chamber and expel the fluid within. This motion also causes diaphragm 10 to draw fluid into its respective fluid chamber. When the diaphragms and connecting rod 11 have traveled through the position shown in FIG. 2B to the predetermined distance shown in FIG. 2C, pressurized air is then introduced to the right diaphragm 10 to reverse the motion back through the positions shown in FIG. 2B and then back to FIG. 2A. By alternating the introduction of pressurized air to the left and right diaphragms in this manner, the pumping motion of the diaphragm pump is continuously repeated.

In operation, when the connecting rod is centered as shown in FIG. 2B, a median impedance is produced in inductance coil 30. As shown in FIG. 2A, as the center of the rod, which divides the ferromagnetic half 26 and non-ferromagnetic half 27 of the connecting rod, travels to the right the amount of ferromagnetic material inside the inductance coil increases. This, in turn, increases the impedance of the inductance coil thereby causing the current drawn to be reduced. Bridge processing circuitry (not shown) such as that described in U.S. Pat. No. 4,667,158, the disclosure of which is herein incorporated by reference, is used to detect the amount of current drawn and, from this, determine the incremental linear position of the rod relative to the housing 3. Conversely, in moving connecting rod to the left through the position shown in FIG. 2B to the position shown in FIG. 2C, the amount of ferromagnetic material in inductance coil 30 decreases thereby decreasing the impedance of the coil and causing the current drawn, which is detected by the bridge processing circuitry described above, to be increased.

Thus, to summarize, by moving the ferromagnetic half of connecting rod 11 into the coil, the mass of ferromagnetic material in inductance coil 30 changes as the connecting rod moves. This, in turn, changes the inductance coil impedance with the impedance increasing proportionally to the amount of the ferromagnetic half contained within the coil. In this manner, the inductance coil 30 may be used as a variable inductor in a resonant circuit to determine the position of connecting rod 11 from the inductance of the coil.

Figure 3A:
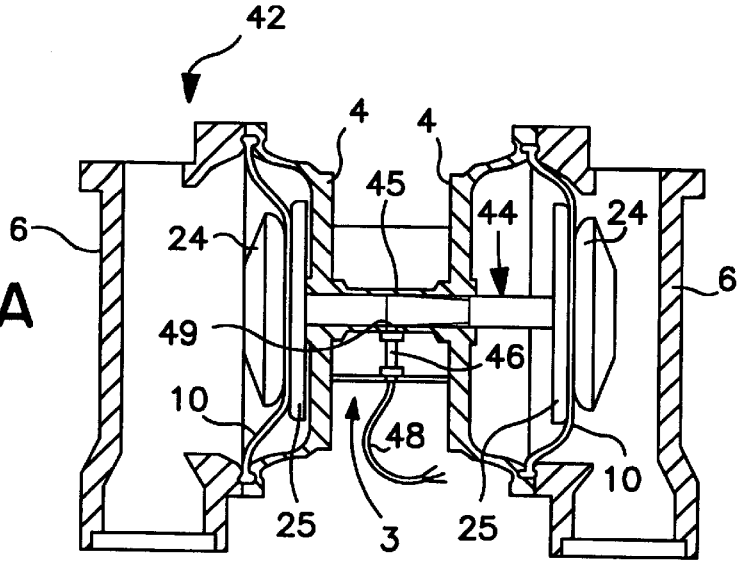
FIGS. 3A–3C are cross-sectional schematic views of a diaphragm pump having an active feedback system according to an alternate embodiment of the present invention moving through successive stages of a pumping stroke.
Figure 3B:
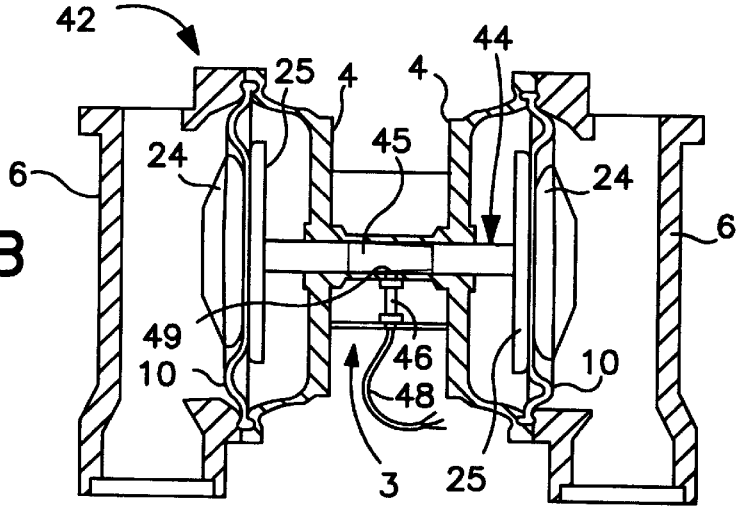
Figure 3C:
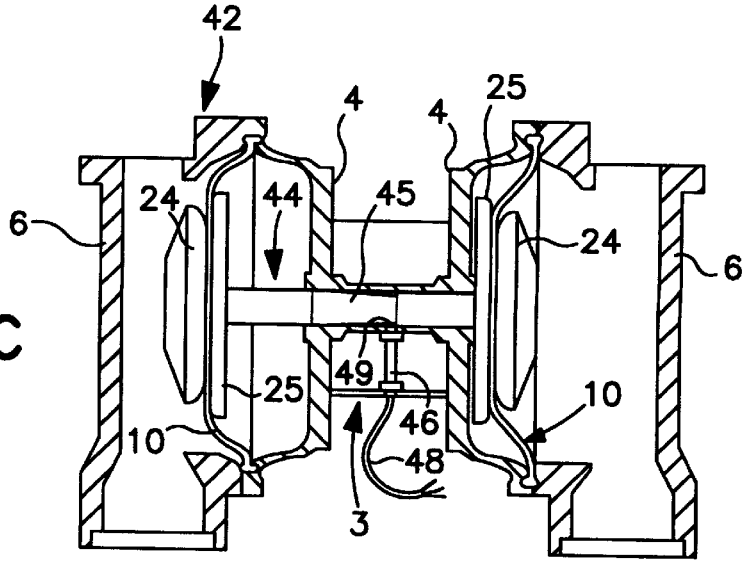

According to another embodiment of the present invention, shown in FIGS. 3A–3C is a cross-sectional schematic that illustrates the motion of two diaphragms in a diaphragm pump 42 similar to that shown in FIGS. 1 and 2A–2C which incorporates a linear displacement sensor 46 with the following additional modifications. Provided between backup washers 25 is a connecting rod 44 having a diametrically tapered portion 45 located in the middle of the rod. Tapered portion 45 is made of an electrically conductive material. Linear displacement sensor 46 is located in the center body of the pump housing 3 as shown and mounted perpendicular to the connecting rod 44 so that in the center position shown in FIG. 3B, a face 49 of the sensor falls in the middle of the tapered portion 45.

In operation, when connecting rod 44 is centered as shown in FIG. 3B, linear displacement sensor 46 produces a median voltage. As connecting rod 44 travels to the right as shown in FIG. 3A, the taper decreases the distance between face 49 of linear displacement sensor 46 and connecting rod 44. As described in greater detail below, this causes the sensor to produce a lower voltage output. Conversely, as the rod shifts to the left as shown in FIG. 3C, the taper increases the gap with face 49 thereby increasing the voltage output of linear displacement sensor 46.

Preferably, linear displacement sensor 46 is a non-contact sensor which uses a magnetic field (also known as an eddy-current field) across face 49 to induce a current in a metal piece placed in the magnetic field. By measuring the power loss caused by the current induced in the metal piece, the proximity of the metal piece with respect to face 49 can be determined. Preferably, a non-contact linear displacement sensor having an analog output such as a LD701 Series sensor available from Omega Engineering Inc., Stamford, Conn. is used to determine the position of connecting rod 44 based upon the output voltage detected. By this design, the non-contact operation of the linear displacement sensor provides an added inherent benefit of virtually infinite life.

Preferably, when using an OMEGA LD701 Series linear displacement sensor, electrically conductive tapered portion 45 is manufactured using a mild steel, a stainless steel, brass aluminum, or copper. When using an OMEGA LD701 Series linear displacement sensor in this fashion, by providing a 14–30 Vdc, 20 mA excitation voltage to leads 48, a magnetic field is provided across face 49.

Upon moving connecting rod 44 sequentially from the position shown in 3A to 3C, typical output voltages ranging from 1–9 volts, respectively, are obtained which correlate with the position of tapered connecting rod 44. These output voltages are inputted via leads 48 to a controller or computer device (not shown) which then determines the position of connecting rod 44 from the voltage signal and can perform additional signal processing and control functions.

The resultant position signals produced by both the inductance coil and the displacement sensors described above are analog and therefore have infinite resolution such that they can be easily converted into a control signal for the pump device using electronic signal processing devices and techniques known in the art. In this fashion, all elements of an analog position signal can thus be used to determine instantaneous position, velocity, and acceleration of the connecting rod thus control the pump accordingly. The inductance coil and displacement sensors described above also provide the advantage that they do not contact the connecting rod and therefore do not wear the rod or otherwise impede its motion.

Although described above with respect to using a particular displacement sensors, it will become readily apparent that other displacement sensors which convert the distance between its sensing face and a moving object to an electronic signal may be utilized.

An important advantage provided by the active feedback apparatus according to the present invention is that by sensing the exact position of a connecting rod as a function of time, a more accurate means for accurately measuring the actual displacement of the rod in real time is provided. For example, the sensing a sudden change in velocity in mid-travel of the connecting rod could be used to detect a ruptured or failed diaphragm or cavitation problem.

Moreover, based upon the information received using the active control devices according to the present invention, corrective action may also be implemented. For example, it is normal for connecting rods in diaphragm pumps to over-travel after the mechanical switching device has been switched. The amount of overtravel will vary, however, with the speed of operation due to the momentum of the backup washers and connecting shaft and the time it takes for the mechanical shifting device to effect the reversal of the motion of the connecting rod. By using active control feedback provided by the present invention, the amount of overtravel can be detected and compensated for in real time by using a computer controller.

Thus, based upon the information provided using the active sensing devices according to the present invention by themselves or when used in conjunction with additional sensors (e.g., pressure transducers or thermocouples) various abnormal conditions may be diagnosed and corrected.

Thus, according to the present invention active feedback apparatus are provided which, by the introduction of sensors and minor modifications to existing diaphragm pump components, produce an output signal proportional to the position of a diaphragm pump connecting rod. Additional benefits are realized by virtue of the minor nature of the component modifications which facilitate the retrofitting of existing pumps to allow field conversion. Moreover, the analog output signal produced by the active feedback apparatus is very versatile and easily converted to permit diagnostic and control functions to be performed on a pump.

While embodiments and applications of this invention have been shown and described, it will be apparent to those skilled in the art that many more modifications are possible without departing from the inventive concepts herein described. For example, although the present invention is shown and described above with respect to monitoring the volumetric displacement of a diaphragm pump, various other output parameters may be anticipated by reading and interpreting internal device conditions by monitoring the connecting rod position. For example, actual dispensing/metering control, stall prevention, noise suppression, etc. may be actively compensated for by reading the position of the connecting rod and performing some function to compensate before they occur at the output.

It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A diaphragm pump having an active feedback system comprising:

a diaphragm pump having a housing including a pumping cavity having at least one diaphragm dividing the pumping cavity into a first pumping chamber and a first pump actuating chamber;

a rod attached to and reciprocally movable along an axis with said at least one diaphragm, said rod having an electrically conductive, diametrically tapered portion; and a linear displacement sensor disposed next to said tapered portion which induces a current in said tapered portion and generates an output voltage proportional to a relative position between said linear displacement sensor and said tapered portion.

2. The diaphragm pump as recited in claim 1 further comprising a second diaphragm attached to and movable with said rod, said second diaphragm being disposed in and dividing a second pumping cavity into a second pumping chamber and a second pump actuating chamber.

3. The diaphragm pump as recited in claim 1 wherein said tapered portion is centered along said rod and said linear displacement sensor is aligned with a midpoint of said tapered portion when said rod is at a midpoint of a reciprocating stroke.

4. The diaphragm pump as recited in claim 2 wherein said tapered portion is centered along said rod and said linear displacement sensor is aligned with a midpoint of said tapered portion when said rod is at a midpoint of a reciprocating stroke.

5. The diaphragm pump as recited in claim 1 wherein said linear displacement sensor is a non-contact OMEGA LD701 Series sensor.

6. The diaphragm pump as recited in claim 2 wherein said linear displacement sensor is a non-contact OMEGA LD701 Series sensor.

* * * * *